United States Patent [19]

DeMars et al.

[11] Patent Number: 4,951,835

[45] Date of Patent: Aug. 28, 1990

[54] BEVERAGE CONTAINER OPENING AND RESEALING DEVICE

[76] Inventors: Robert A. DeMars, 6008 Weeping Banyon La., Woodland Hills, Calif. 91367; Spencer L. Mackay, 28765 Pisces St., Agoura Hills, Calif. 91301

[21] Appl. No.: 465,346

[22] Filed: Jan. 16, 1990

[51] Int. Cl.[5] ..... B65D 17/34

[52] U.S. Cl. ..... 220/269; 220/258; 220/359

[58] Field of Search ..... 220/258, 269, 270, 271, 220/272, 273, 359

[56] References Cited

U.S. PATENT DOCUMENTS

| | | | |
|---|---|---|---|
| 4,463,866 | 8/1984 | Mandel | 220/269 |
| 4,493,431 | 1/1985 | Cho | 220/269 |
| 4,605,141 | 8/1986 | Won | 220/269 |
| 4,673,099 | 6/1987 | Wells | 220/269 |

*Primary Examiner*—Stephen Marcus
*Assistant Examiner*—Nova Stucker
*Attorney, Agent, or Firm*—Jack C. Munro

[57] ABSTRACT

A frangible seal breaking and aperture resealing device for a beverage container which utilizes a handle being pivotally mounted on the top of the beverage container. The handle is movable from a stowage position to a frangible seal breaking position and then to an aperture resealing position. There is incorporated on the top a camming protuberance which has the function of locating the handle in an inclined or canted position so as to facilitate its movement to frangibly separate a breakaway tab incorporated within the top of the beverage container. The camming protuberance also exerts a biasing force tending to maintain the handle in the resealing position.

18 Claims, 2 Drawing Sheets

BEVERAGE CONTAINER OPENING AND RESEALING DEVICE

BACKGROUND OF THE INVENTION

The field of this invention relates to beverage cans and more particularly to the aluminum type of beverage can which has integrally incorporated therein an opening device known as a pop-top of the anti-litter type.

Billions of aluminum cans are produced annually for the packaging of beer, soda and other beverages. It is common that these cans include a frangible tab within its top surface. Associated with the frangible tab is a pivotable handle. The handle is to be pivoted by the user to cause breakage of the frangible seal between the tab and the top of the can and cause the tab to deflect inwardly to the interior of the can exposing an aperture through which the contents of the beverage can can now be dispensed.

Most beverage cans are in the range of twelve ounces. Many times a consumer will not wish to consume twelve ounces of the beverage at a single sitting. A great number of beverages are under pressurization. Therefore, if the beverage is left exposed, for even a short period of time to the atmosphere, this pressurization will be lost with the result that the beverage will then become "flat". When a beverage has become "flat", the taste of the beverage is affected. Therefore, in a great many instances, if an individual does not consume all of the beverage at a single sitting, the unconsumed amount is merely discarded. Although beverage manufacturers certainly do not object to this increased consumption of the beverage, it still constitutes a waste.

At the present time, we are in an era of energy conservation. Therefore, if the unconsumed contents of a beverage can be saved to be consumed at a later time, inherently there will also be a saving of energy. Energy will be required to produce only the beverage that is consumed by the user and not discarded.

In order to avoid the discarding of the beverage, it is only necessary to find some way to reseal the beverage after a portion of the contents of the beverage has been consumed. In the past, it has been known to redesign the "pull-tab" devices of beverage cans so that in some way the pull-tab can be used to reseal the aperture that is produced within the beverage container. A common form of such device is to include a protruding section in association with the handle that is used to affect the breaking of the frangible seal. When it is desired to reseal the aperture, the handle is pivoted over the aperture with this protrusion being tightly pressed into the aperture forming an airtight seal. However, these types of resealing devices have not achieved any significant market acceptance. It is believed that the reasons that market acceptance has been lacking is that the devices are complicated and inherently expensive, therefore, significantly increasing the cost of the beverage container to the consumer. Also, such devices are somewhat complicated to operate and at times may be difficult to operate by older people or people with arthritis or other afflictions. Still further, once the beverage can is resealed, the pressure within the can tends to increase. It is common that this increase in pressure will be sufficient to cause the resealing device to be disengaged from the aperture thereby again exposing the contents of the beverage container to the atmosphere.

SUMMARY OF THE INVENTION

A frangible seal breaking and aperture resealing device for the top of a beverage container which incorporates a conventional tab which is integrally connected by a frangible seal to the top which must be broken in order to dispense the contents of the beverage container. A handle is mounted on the top with the handle being pivotally movable from a stowage position to a position where the handle can be pivoted to affect breaking of the seal and cause pivoting of the tab to an out-of-the-way position within the interior of the beverage container. The handle can also be moved to cover the aperture with an adhesive pad on the undersurface of the handle to be then exposed with this pad coming into contact with the area of the top directly around the aperture that is produced by the removing of the tab. There is a camming protuberance mounted on the top which locates the handle in a canted position to facilitate grasping of the tab and moving of the tab to cause breaking of the frangible seal. Also, the camming protuberance functions to exert a force tending to maintain the handle in the resealing position.

The primary objective of the present invention is to construct a resealing device in conjunction with the frangible seal breaking device of a conventional aluminum can beverage container which is simple in construction and therefore inexpensive to manufacture.

Another object of the present invention is to construct a frangible seal breaking and aperture resealing device for an aluminum beverage container which can be operated easily by unskilled individuals as well as individuals with physical ailments such as arthritis.

DETAILED DESCRIPTION OF THE SHOWN EMBODIMENT

Figure 1:
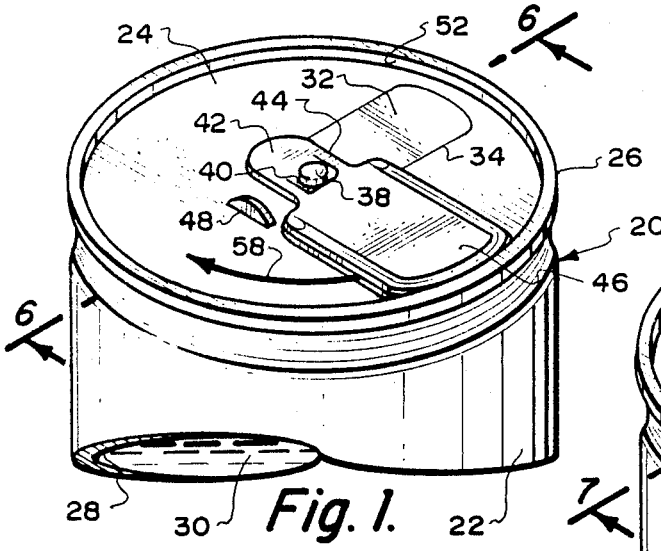
FIG. 1 is an isometric view of the top of a typical beverage container showing the device of this invention in a stowage position.

Referring particularly to the drawings there is shown a conventional beverage container 20 which is composed of metal, such as aluminum, and is constructed of a basically cylindrical side wall 22 which is closed at the lower end thereof (not shown) and at the upper end by a top 24. The top 24 is seamed at the periphery by a seam 26 to the side wall 22. Beverage container 20 includes an internal compartment 28. Within the compartment 28 is to be located a quantity of a liquid beverage 30.

Figure 8:
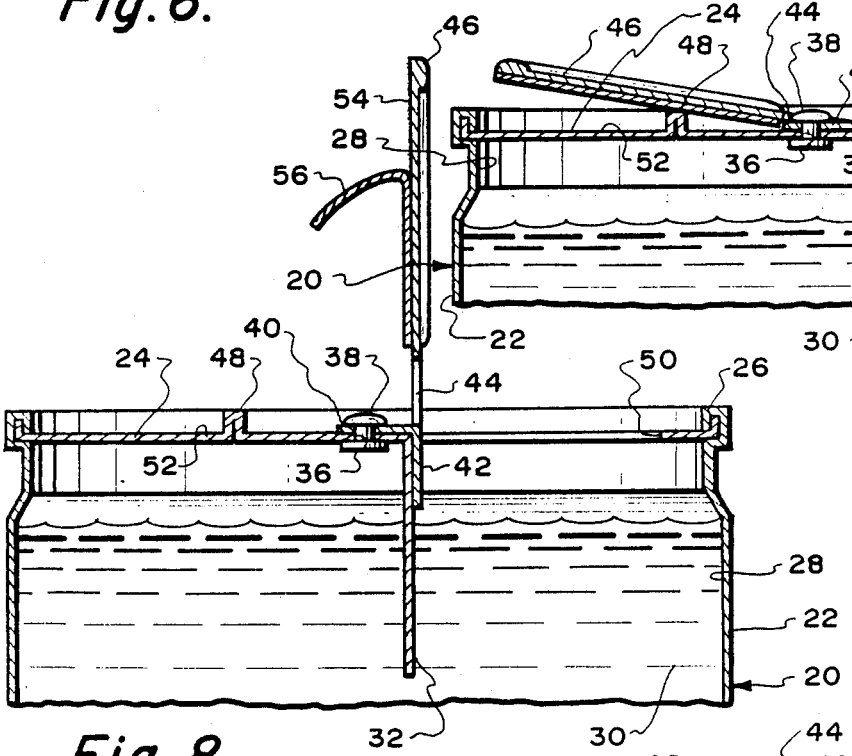
FIG. 8 is a cross-sectional view taken along line 8—8 of FIG. 3.
Figure 9:
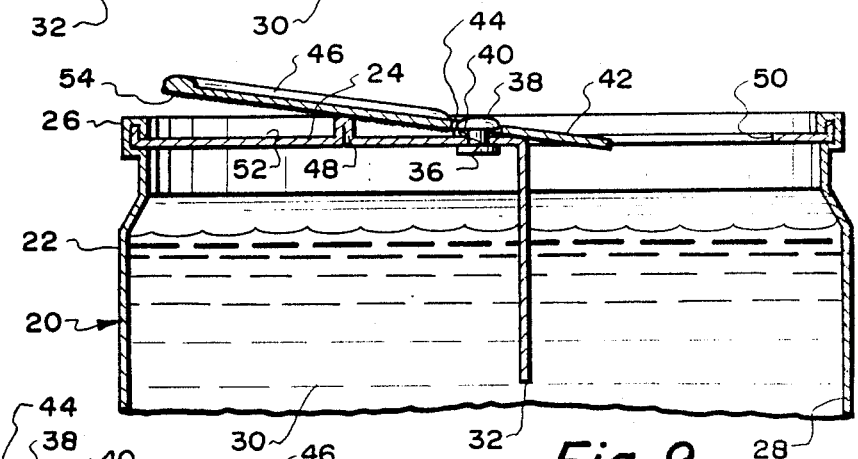
FIG. 9 is a cross-sectional view taken through line 9—9 of FIG. 4.

Within the top 24 is located at tab 32. This tab 32 is connected by a frangible seal 34 to the top 24. Sufficient amount of physical pressure being applied to the upper surface of the tab 32 will result in the frangible seal 34 breaking which will permit the tab 32 to be pivoted within the internal compartment 28 as is clearly shown within FIGS. 8 and 10 of the drawings.

Centrally formed within the top 24 is a pivot hole 36. Connecting with the pivot hole 36 is a pivot pin 38. The pivot pin 38 has an enlarged head at each end so as to capture a flange 40 through which the pin 38 is conducted. In essence, the pin 38 resembles a rivet.

Flange 40 is integrally connected to a lever 42. Integrally connected to the lever 42 by means of bifurcated section 44 is a handle 46.

Fixedly mounted on the top 24 is a camming protuberance 48. The pivot hole 36 is located directly between the camming protuberance 48 and the aperture 50 through which the beverage 30 is to be dispensed. It is to be noted that the height of the camming protuberance 48 is substantially identical to the height of the seam 26. Most of the area of the top 24 defines a recess 52. When the handle 46 is in the stowage position as is clearly shown in FIG. 1 of the drawings, the handle 46, as well as the lever 42, are totally confined within this recess 52.

Coated on the undersurface of the handle 46 is a layer of adhesive 54. Various types of adhesive could be utilized. However, generally it is important that the adhesive be non-toxic and basically non-dissolvable by coming into contact with the beverage 30. Placed on the adhesive layer 54 is a release paper 56.

The operation of the device of this invention is as follows: At the time the consumer receives the beverage container 20, the handle 46 is in the stowage position shown in FIG. 1. The fact that the handle 46, as well as lever 42 are totally confined within the recess 52, handle 46 will not interfere with any exterior structures during shipping, marketing and refrigerated storage of the beverage container 20 prior to its being used.

Figure 2:
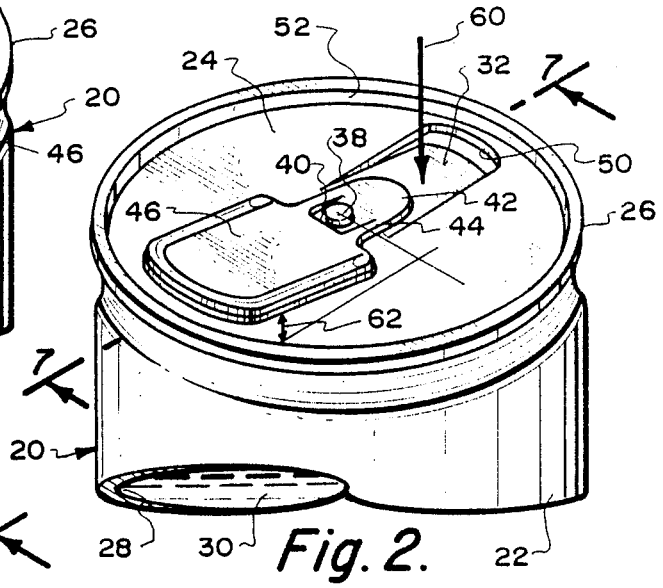
FIG. 2 is an isometric view similar to FIG. 1 but showing the handle of the device of this invention being moved to the initial stage of using the handle to break the frangible seal between the tab and the top of the beverage container.
Figure 3:
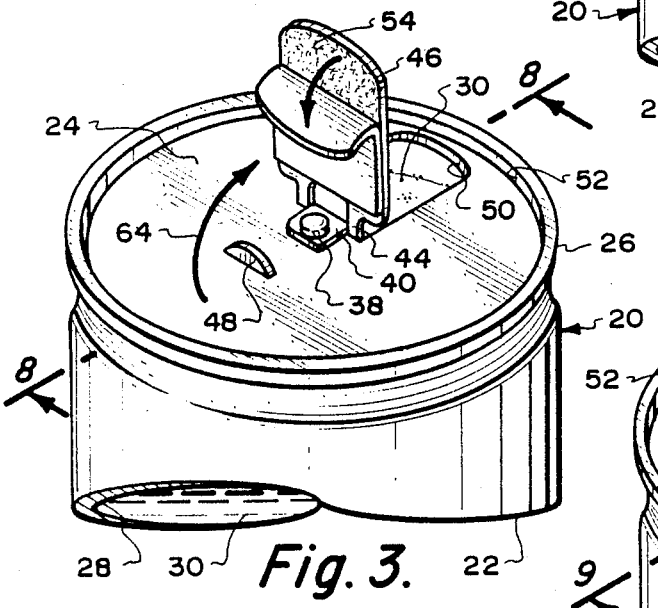
FIG. 3 is an isometric view similar to FIG. 2 but showing the handle in the position of causing breakage of the frangible seal.
Figure 4:
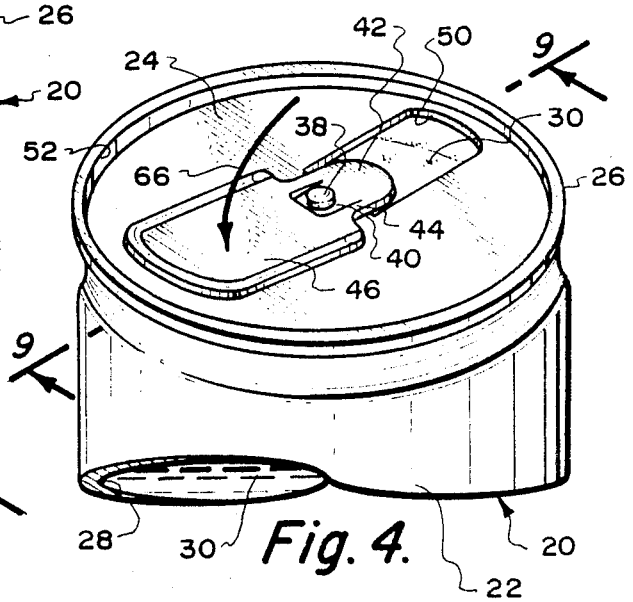
FIG. 4 is an isometric view similar to FIG. 2 with the exception that the frangible seal has been broken and the contents of the beverage container can now be dispensed through the aperture now formed within the top of the beverage container.
Figure 7:
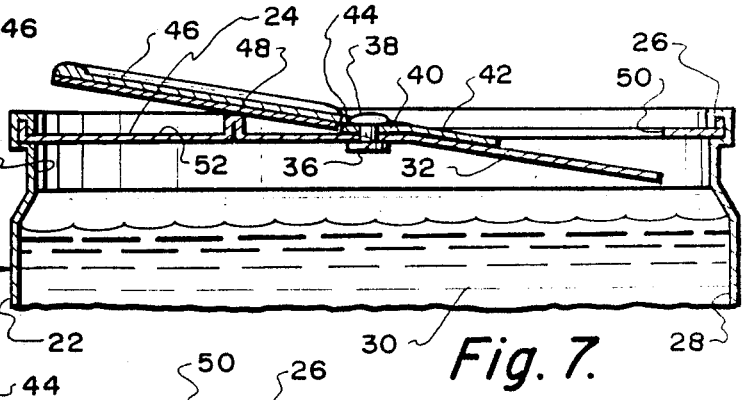
FIG. 7 is a cross-sectional view taken along line 7—7 of FIG. 2.

When the consumer desired to consume part of the beverage 30, the consumer applies pressure against the handle 46 causing the handle 46 to move in the direction of arrow 58. When the amount of movement approaches ninety degress, the handle 46 will come into contact with camming protuberance 48 and will ride in an upward direction away from the top 24. As a result, the handle 46 will assume an inclined or canted position such as is shown in FIGS. 2 and 7. More than likely during the assuming of this canted position of the handle 46, the lever 42 will cause frangible seal 34 to be broken since the lever 42 will apply a downward force represented by arrow 60. Generally, the actual distance that the back end of the handle 46 rises off the top 24 is approximately one-fourth to three-eighths of an inch as is represented by arrow 62.

The operator then proceeds to manually apply an upward force to the handle 46 as is represented by arrow 64 until the handle 46 assumes a substantially perpendicular position relative to the top 24. At this particular time, the tab 32 is caused to be bent to assume a substantially right angled position to the top 24 with this tab 32 being located within internal compartment 28.

If the consumer knows that he or she intends to reseal the beverage container 20, the consumer will at this time remove the release paper 56 exposing the adhesive layer 54. The consumer will then also bend handle 46 in a downward direction, as represented by arrow 66, until the handle 46 comes into contact with the camming protrusion 48. At this particular time, the aperture 50 is available to provide for dispensing of the beverage 30.

Let it now be assumed that the consumer wishes to close the aperture 50 to the ambient. The consumer only needs to pivot the handle 46 one hundred eighty degrees as is represented by arrow 68. As a result, the adhesive layer 54 is moved into juxtaposition with the aperture 50. It is actually the edge of the adhesive layer 54 that will engage with the portion of the top 24 that is in close proximity to and surrounds the aperture 50. As the adhesive layer 54 adheres to the top surrounding the aperture 50, the lever 42 rides up on the camming protrusion 48. This applies a force on the handle 46 in the downward direction tending to maintain the adhesive layer 54 in tight contact with the top 24. As a result, a fluid tight seal is produced about the aperture 50 which not only prevents escape of any of the beverage 30 but also prevents escape of any of the pressurized gas contained within the internal compartment 28.

When it is desired to again dispense some of the beverage 30, the user only needs to apply a lateral pressure against the lever 42 tending to disengage such from the camming protuberance 48. This will result in release of the adhesive connection between the handle 46 and the top 24. Once the lever 42 is disengaged from the camming protrusion 48, the handle 46 will automatically tilt slightly which will further facilitate manual movement of the handle 46 to a position so as to expose the aperture 50 and hence facilitate the dispensing of the beverage 30.

Figure 5:
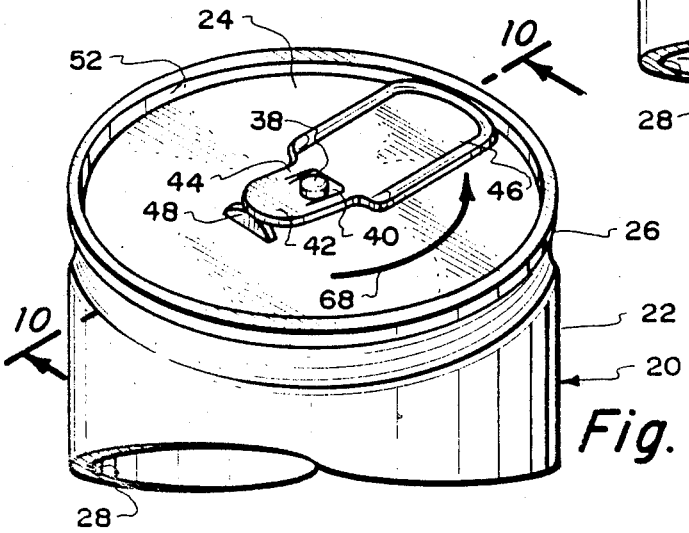
FIG. 5 is an isometric view similar to FIG. 4 but showing the handle of the device of this invention now moved to the resealing position.
Figure 6:
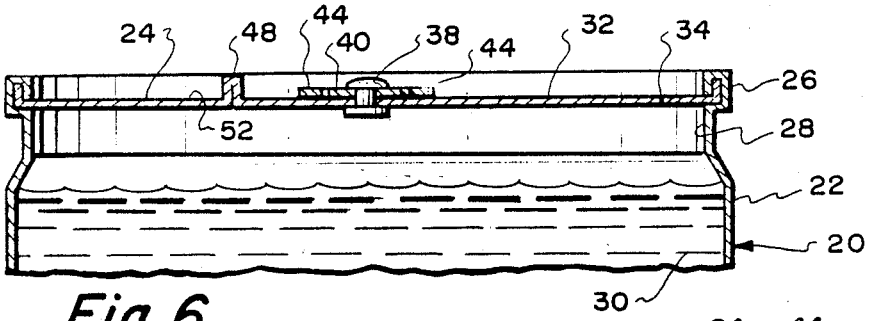
FIG. 6 is a cross-sectional view taken along line 6—6 of FIG. 1.
Figure 10:
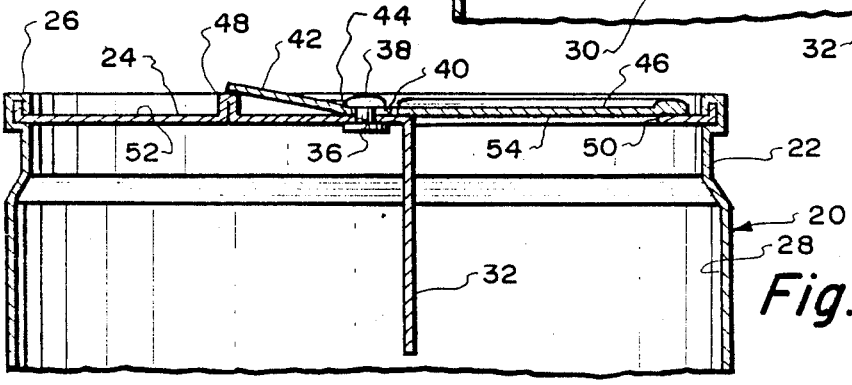
FIG. 10 is a cross-sectional view taken along line 10—10 of FIG. 5.

It is to be understood that a consumer may effect a further resealing of the aperture 50 if such is deemed to be desired by again moving of the handle 46 to the resealing position such as shown in FIGS. 5 and 10 of the drawings.

What is claimed is:

1. In combination with a beverage container having an end wall commonly referred to as a top, said top being constructed of a thin walled rigid material, said beverage container having an internal compartment adapted to contain liquid contents, a contents removing aperture formed in said top, a tab normally closing said aperture, a frangible seal integrally connecting said top and said tab, an opening mechanism mounted on said top, said opening mechanism including a handle integrally connected with a lever, a pivot hole located between said lever and said handle, a pivot pin engaging said pivot hole, said pivot pin being mounted on said top, the improvement comprising:

a camming protuberance mounted on said top, said pivot pin being located directly between said camming protuberance and said aperture, said handle being movable between a stowage position and a frangible seal breaking position and a resealing position, said handle being substantially flush against said top when in said stowage position, when said handle is moved to rest on said camming protuberance said handle assumes a canted position relative to said top to thereby facilitate manual grasping of said handle and pivoting of said lever into contact with said tab and breaking of said frangible seal resulting in pivoting of said tab into said internal compartment, said handle to be movable back into substantial contact with said camming protuberance during pouring of the contents from said aperture, said handle having an undersurface, an adhesive mounted on said undersurface, said handle to be movable about said pivot pin covering said aperture when in said resealing position, when said handle is in said resealing position said lever is at a canted position by being located against said camming protuberance which also forces said undersurface of said handle against said top with said adhesive forming a fluid tight seal between said top and said handle and closing of said aperture.

2. The combination as defined in claim 1 wherein:

said pivot hole being substantially centrally located on said top.

3. The combination as defined in claim 2 wherein:

said handle forming a bifurcated connection with said lever about said pivot pin.

4. The combination as defined in claim 1 wherein:

position of said handle in said stowage position is approximately ninety degrees from the position of said handle in said frangible seal breaking position and the position of said handle when in said sealing position, thereby said handle being approximately one hundred eighty degrees different in position between said frangible seal breaking position and said resealing position.

5. The combination as defined in claim 1 wherein:

said handle being confined within the peripheral area of said top.

6. The combination as defined in claim 1 wherein:

a release paper normally covering said adhesive during the time that said adhesive is not in usage, said release paper to be physically removed prior to locating of said handle in said resealing position.

7. A beverage container having a planar surface, a tab connected by a frangible seal with said planar surface, breaking of said frangible seal produces an aperture through which the contents of said beverage container are to be removable, a frangible seal breaking and aperture resealing device comprising:

a handle pivotally mounted on said planar surface, said handle being locatable in either a stowage position or a frangible seal breaking position or an aperture resealing position, said handle being moved approximately ninety degrees along said planar surface between said stowage position and said frangible seal breaking position, said handle being in a canted position relative to said beverage container when in said frangible seal breaking position prior to moving of said handle against said tab causing breaking of said frangible seal, said handle being moved approximately one hundred eighty degrees along said planar surface between said frangible seal breaking position and said aperture resealing position, said handle closes said aperture in a liquid tight manner when said handle is in said aperture resealing position.

8. The beverage container as defined in claim 7 wherein:

said handle being located flush against said beverage container when in said stowage position and when in said resealing position.

9. The beverage container as defined in claim 7 wherein:

a camming protuberance mounted on said beverage container, said handle resting on said camming protuberance when in said frangible seal breaking position prior to being moved causing breaking of said frangible seal.

10. The beverage container as defined in claim 7 wherein:

said handle having an undersurface, said undersurface being located nearest said planar surface, an adhesive mounted on said undersurface, said adhesive facilitating the forming of a fluid tight seal between said planar surface and said handle when in said aperture resealing position.

11. The beverage container as defined in claim 10 wherein:

a release paper normally covering said adhesive during the time that said adhesive is not in usage, said release paper to be physically removed prior to locating of said handle in said aperture resealing position.

12. A beverage container having a tab connected by a frangible seal with the main body of said beverage container, breaking of said frangible seal produces an aperture through which the contents of said beverage container are to be removable, a frangible seal breaking and aperture resealing device comprising:

a handle pivotally mounted on said beverage container, said handle being locatable in either a stowage position or a frangible seal breaking position or an aperture resealing position, said handle being moved approximately ninety degrees between said stowage position and said frangible seal breaking position, said handle being moved approximately one hundred eighty degrees between said frangible seal breaking position and said aperture resealing position, said handle closes said aperture in a liquid tight manner when said handle is in the resealing position;

said handle being located flush against said beverage container when in said stowage position and when in said resealing position; and said handle being in a canted position relative to said beverage container when in said frangible seal breaking position prior to moving of said handle against said tab causing breaking of said frangible seal.

13. The beverage container as defined in claim 12 wherein:

a camming protuberance mounted on said beverage container, said handle resting on said camming protuberance when in said frangible seal breaking position prior to being moved causing breaking of said frangible seal.

14. In combination with a beverage container having an end wall commonly referred to as a top, said top being constructed of a thin walled rigid material, said beverage container having an internal compartment adapted to contain liquid contents, a contents removing aperture formed in said top, a tab normally closing said aperture, a frangible seal integrally connecting said top and said tab, an opening mechanism mounted on said top, said opening mechanism including a handle integrally connected with a lever, a pivot hole located between said lever and said handle, a pivot pin engaging said pivot hole, said pivot pin being mounted on said top, the improvement comprising:

a camming protuberance mounted on said top, said pivot pin being located directly between said camming protuberance and said aperture, said handle being movable between a stowage position and a frangible seal breaking position, said handle being substantially flush against said top when in said stowage position, when said handle is moved to rest on said camming protuberance said handle assumes a canted position relative to said top to thereby facilitate manual grasping of said handle and pivoting of said lever into contact with said tab and breaking of said frangible seal resulting in pivoting of said tab into said internal compartment, said handle to be movable back into substantial contact with said camming protuberance during pouring of the contents from said aperture.

15. The combination as defined in claim 14 wherein: said pivot hole being substantially centrally located on said top.

16. The combination as defined in claim 15 wherein: said handle forming a bifurcated connection with said lever about said pivot pin.

17. The combination as defined in claim 14 wherein: position of said handle in said stoage position is approximately ninety degrees from the position of said handle in said frangible seal breaking position.

18. The combination as defined in claim 14 wherein: said handle being confined within the peripheral area of said top.

* * * * *